US012623820B2

(12) United States Patent
Borgardt et al.

(10) Patent No.: US 12,623,820 B2
(45) **Date of Patent: *May 12, 2026**

(54) CONTAINER CAP AND METHOD OF PIERCING A SEAL COVERING AN OPENING OF A CONTAINER

(71) Applicant: AbbVie Inc., North Chicago, IL (US)

(72) Inventors: Joy Elizabeth Borgardt, Evanston, IL (US); James J. Hughes, Libertyville, IL (US); Ted Klikuszowian, Arlington Heights, IL (US); Todd Marshall, Lindenhurtst, IL (US); Marc Plew, Gurnee, IL (US); Kelsey M. Coffey, Evansville, IN (US); Scott L. Fisher, Evansville, IN (US); Jason A. Rowe, Santa Claus, IN (US)

(73) Assignee: AbbVie Inc., North Chicago, IL (US)

( * ) Notice: Subject to any disclaimer, the term of this patent is extended or adjusted under 35 U.S.C. 154(b) by 114 days.

This patent is subject to a terminal disclaimer.

(21) Appl. No.: 16/500,597

(22) PCT Filed: Apr. 16, 2018

(86) PCT No.: PCT/US2018/027730

§ 371 (c)(1),
(2) Date: Oct. 3, 2019

(87) PCT Pub. No.: WO2018/194957

PCT Pub. Date: Oct. 25, 2018

(65) Prior Publication Data

US 2020/0189814 A1 Jun. 18, 2020

Related U.S. Application Data

(60) Provisional application No. 62/487,942, filed on Apr. 20, 2017.

(51) Int. Cl.
*B65D 51/22* (2006.01)
*B65D 41/02* (2006.01)
*B65D 50/04* (2006.01)

(52) U.S. Cl.
CPC ..... *B65D 51/22* (2013.01); *B65D 41/02* (2013.01); *B65D 50/04* (2013.01); *B65D 50/041* (2013.01);
(Continued)

(58) Field of Classification Search
CPC .... B65D 51/223; B65D 51/222; B65D 51/20; B65D 51/22; B65D 51/228; B65D 50/041
See application file for complete search history.

(56) References Cited

U.S. PATENT DOCUMENTS 616,304 A 12/1898 Falk
D188,771 S 9/1960 Chaplin et al.
(Continued)

FOREIGN PATENT DOCUMENTS

CN 1390176 A 1/2003
CN 202368914 U 8/2012
(Continued)

OTHER PUBLICATIONS

Chinese Office Action and Search Report for Application No. 201880026138.5 dated Nov. 30, 2020. (13 pages).

*Primary Examiner* — Anthony D Stashick
*Assistant Examiner* — Blaine G Neway
(74) *Attorney, Agent, or Firm* — Armstrong Teasdale LLP

(57) ABSTRACT

A container cap (100) configured to couple to an access opening of a container, and the access opening having a seal configured to cover the access opening. The container cap includes a cap body (102) including a cylindrical-shaped side wall (104) having a bottom edge (108) that defines an opening to an interior of the cap body, and a top wall portion
(Continued)

integrated with the cylindrical-shaped side wall and at least partially enclosing the interior of the cap body. The container cap further includes a seal opening assembly integrated with the cap body. The seal opening assembly includes a slot (114) defined in the top wall portion of the cap body, and a seal piercing member (116) formed on a first side of the slot. The seal piercing member is configured to pierce the seal covering the access opening.

15 Claims, 5 Drawing Sheets

(52) U.S. Cl.
CPC ..... *B65D 51/223* (2013.01); *B65D 51/228* (2013.01); *B65D 2251/0015* (2013.01); *B65D 2251/0093* (2013.01)

(56) References Cited

U.S. PATENT DOCUMENTS 3,255,910 A * 6/1966 Winston ..... B65D 51/223 215/311
D210,867 S 4/1968 Kuroda
D261,619 S 11/1981 Borkan
4,458,820 A 7/1984 Abrams
4,634,013 A 1/1987 Bar-Kokhba
5,148,937 A 9/1992 Huard
5,797,506 A 8/1998 Lehmkuhl et al.
D399,743 S 10/1998 Coon et al.
6,024,234 A 2/2000 Rink et al.
D435,794 S 1/2001 Schmidt et al.
6,182,845 B1 * 2/2001 Wolfe ..... B65D 51/223 215/228
D446,103 S 8/2001 Olaneta
D459,174 S 6/2002 Debergen
D459,963 S 7/2002 Usbeck
D481,948 S 11/2003 Brozell et al.
D501,774 S 2/2005 Bates et al.
D586,213 S 2/2009 Wells et al.
D592,507 S 5/2009 Wachman et al.
D605,011 S 12/2009 Jalet
D607,326 S 1/2010 Branson et al.
D611,346 S 3/2010 Camomile
7,673,767 B2 * 3/2010 Vovan ..... B65D 21/0237 220/212
D621,254 S 8/2010 Camisasca
D651,897 S 1/2012 Miceli et al.
D663,179 S 7/2012 Mauffette
D675,522 S 2/2013 Kawamura et al.
D678,771 S 3/2013 Kawamura
D680,002 S 4/2013 Miceli et al.
D686,513 S 7/2013 Henriksson
D692,762 S 11/2013 Walter et al.
8,616,090 B2 * 12/2013 Ferraro ..... B67B 7/24 81/3.48
D707,556 S 6/2014 Kawamura
D708,521 S 7/2014 Buschmann et al.
9,376,240 B1 6/2016 Mcmurray et al.
D765,512 S 9/2016 Joulia
D790,966 S 7/2017 Roberts et al.
9,725,214 B2 * 8/2017 Crosby ..... B65D 41/18
D799,963 S 10/2017 Akiyama
9,850,048 B2 12/2017 Burbank et al.
D838,172 S 1/2019 Tartock et al.
D845,766 S 4/2019 Tartock et al.
D845,767 S 4/2019 Holmes
D851,488 S 6/2019 Tartock et al.
2003/0071042 A1 4/2003 Adams
2008/0078686 A1 4/2008 Vovan
2011/0126675 A1 6/2011 Ferraro
2015/0008152 A1 1/2015 Xu et al.
2015/0157535 A1 6/2015 Frishman et al.
2016/0025112 A1 1/2016 Moore
2016/0065705 A1 * 3/2016 Nam ..... B65D 43/0208 455/575.8
2016/0251128 A1 9/2016 Burbank et al.
2016/0327427 A1 11/2016 Briones et al.
2018/0305094 A1 10/2018 Borgardt et al.

FOREIGN PATENT DOCUMENTS

GB 489778 A 8/1938
JP 2002529326 A 9/2002
JP 2010202273 A 9/2010
KR 20110073629 A 6/2011
WO WO-2010101155 A1 * 9/2010 ..... B65D 51/223

* cited by examiner

CONTAINER CAP AND METHOD OF PIERCING A SEAL COVERING AN OPENING OF A CONTAINER

BACKGROUND

The field of the present disclosure relates generally to a container cap for a membrane-sealed container and, more specifically, to a container cap with an integrated seal piercing member that is configured to pierce the membrane for easy opening and access to the contents of the container.

At least some known containers have an opening sealed with a membrane to, among other things, facilitate preserving the contents of the container, facilitate detection of tampering with the container, and inhibit accidental spillage of the contents of the container. The containers may be covered with a squeeze-lock container cap that requires simultaneously squeezing and rotating the cap to remove it from the container. However, patients having limited dexterity may find it difficult to remove the cap from the container and then break the membrane to access its contents. For example, breaking the membrane by hand to gain access to the contents of the container can be a difficult and time-consuming task for patients having limited dexterity. In some cases, breaking the membrane can also be a dangerous task if a consumer uses a sharp object, such as a knife, to puncture the membrane.

In some known containers, the container cap may include a seal breaker designed to enable a consumer to use the container cap as a tool to break the membrane. However, these known container caps may not be easily usable by the consumer for opening the container. For example, one known container cap includes a seal breaker formed on the side of the container cap, which makes it difficult and awkward to orient the cap properly for breaking the membrane. In other known containers, the seal breaker may be conspicuously designed such that the seal breaker detracts from the aesthetic appearance of the container and/or may actually harm the user of the seal breaker while attempting to remove the cap or use the seal breaker. Accordingly, a container cap is needed that is easily grippable, that reduces a risk of injury when using a sharp object to pierce the membrane, that includes an integrated seal piercing member that is configured to easily pierce the seal member of the container, and that is integrated into the cap design such that it does not detract from the appearance of the container.

BRIEF DESCRIPTION

In one aspect, a container cap configured to couple to an access opening of a container, and the access opening having a seal configured to cover the access opening. The container cap includes a cap body including a cylindrical-shaped side wall having a bottom edge that defines an opening to an interior of the cap body, and a top wall portion integrated with the cylindrical-shaped side wall and at least partially enclosing the interior of the cap body. The container cap further includes a seal opening assembly integrated with the cap body. The seal opening assembly includes a slot defined in the top wall portion of the cap body, and a seal piercing member formed on a first side of the slot. The seal piercing member is configured to pierce the seal covering the access opening.

In another aspect, a container is provided. The container includes a container body including a neck portion and an interior. The neck portion defines an opening in the container body that provides access to the interior, and the opening is configured to be covered by a seal. The container further includes a container cap selectively removable from the container body. The container cap includes a cap body including a cylindrical-shaped side wall having a bottom edge that defines an opening to an interior of the cap body, and a top wall portion integrated with the cylindrical-shaped side wall and at least partially enclosing the interior of the cap body. The container cap further includes a seal opening assembly integrated with the cap body. The seal opening assembly includes a slot defined in the top wall portion of the cap body, and a seal piercing member formed on a first side of the slot. The seal piercing member is configured to pierce the seal covering the access opening.

In yet another aspect, a method of piercing a seal covering an opening in a neck portion of a container is provided. The method includes orienting a container cap upside down relative to the container, wherein the container cap includes a cap body and a seal opening assembly integrated therewith. The seal opening assembly includes a slot defined in a top wall portion of the cap body, and a seal piercing member formed on a first side of the slot. The method further includes aligning the slot in the cap body with the neck portion of the container, and forcing the container cap towards the container such that the neck portion is inserted within the slot, and such that the seal piercing member pierces the seal covering the opening.

DETAILED DESCRIPTION

Figure 1:
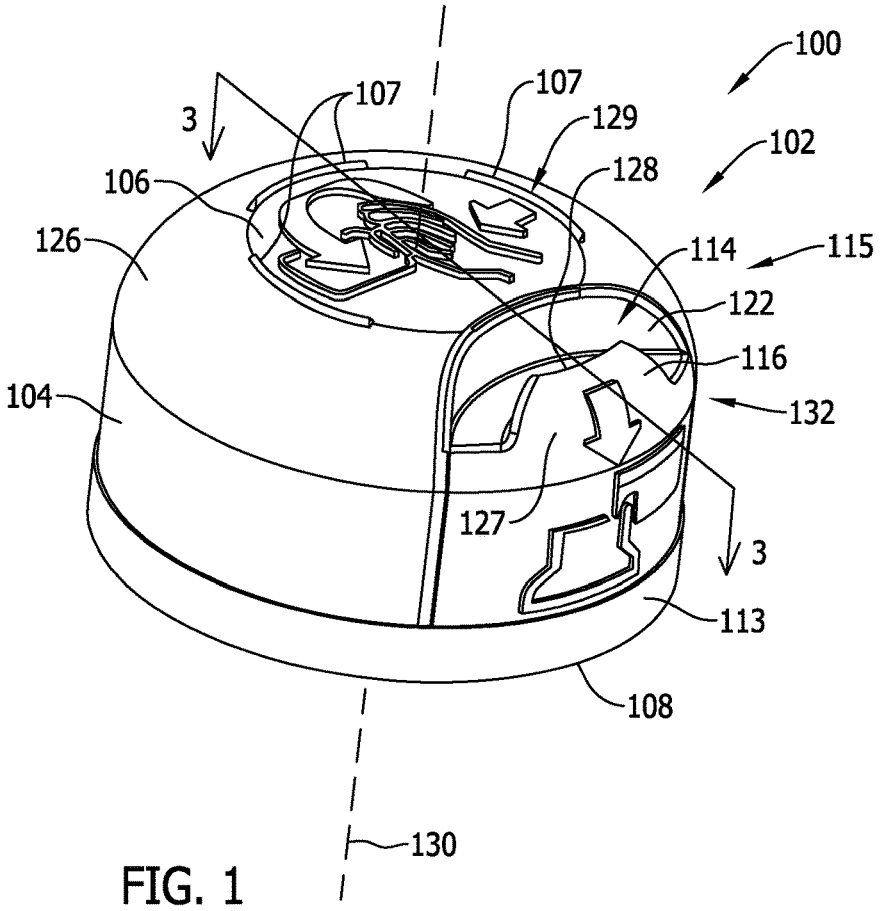
FIG. 1 is a perspective view of an example container cap.

The following detailed description illustrates the disclosure by way of example and not by way of limitation. The description enables one skilled in the art to make and use the disclosure, describes several embodiments, adaptations, variations, alternatives, and use of the disclosure, including what is presently believed to be the best mode of carrying out the disclosure.

Embodiments of the present disclosure relate to a container cap with an integrated seal piercing member. The container cap may be associated with, and selectively removable from, a container having a seal covering an opening thereof. The container may be used to store pharmaceutical products, for example, and the seal facilitates preserving the contents of the container during storage or transport of the container to a consumer. When the consumer is ready to access the contents of the container, the consumer must first remove the cap and then the seal from the container opening. In the example embodiment, the consumer would do so by using the integrated seal piercing member that is part of the container cap. As used herein, the term consumer means a person or person(s) who is consuming or using contents from the container (e.g. a patient), a healthcare provider, and/or a patient assistant providing the contents from the container to the person(s) consuming the contents from the container.

In one embodiment, the container cap described herein acts as the tool that facilitates breaking the seal covering the opening of the container. The container cap includes a cap body including a top wall portion that has a slot defined therein. The slot extends across the top wall portion such that a seal piercing member is formed from the cap body on one side of the slot. The seal piercing member is contoured to substantially match the outer profile of the cap body such that the aesthetic appearance and ergonomic design of the container cap is maintained. In addition, the cap body is designed such that the seal piercing member is readily apparent and conspicuously identifiable to the consumer as a seal breaking tool. In some embodiments, the container cap may include an instructional guide feature that is displayed on an outer surface of the cap body, and that provides the consumer with instructions on how to use the container cap to break the seal.

In one embodiment, the slot extends arcuately across the top wall portion of the cap body, and is oriented convexly relative to a longitudinal axis of the cap body. As such, the seal piercing member is located on a peripheral edge of the cap body. When using the container cap to break the seal covering the opening of the container, the container cap is oriented upside down relative to the container and is then positioned over the container until a neck portion of the container is inserted within the slot. The slot is oriented such that when the container cap is engaged with the neck portion of the container (e.g., the top rim of the opening of the container), the seal piercing member is positioned on a radially inner side of the neck portion, and a majority of the cap body is positioned on a radially outer side of the neck portion. In other words, the slot is oriented such that the majority of the cap body overhangs from the neck portion of the container and provides an easily graspable member for the consumer to leverage when using the container cap to break the seal. Once positioned over the neck portion of the container, the consumer pushes down on the cap such that the seal piercing member punctures the seal, and then may translate the container cap circumferentially about the top rim to further remove the seal from the container. The arcuate shape of the slot in the container cap facilitates guiding the container cap about the top rim. As such, the consumer is provided with a tool capable of opening a sealed container in an efficient and easy to use manner. The container cap may then be used to re-close the container.

Figure 2:
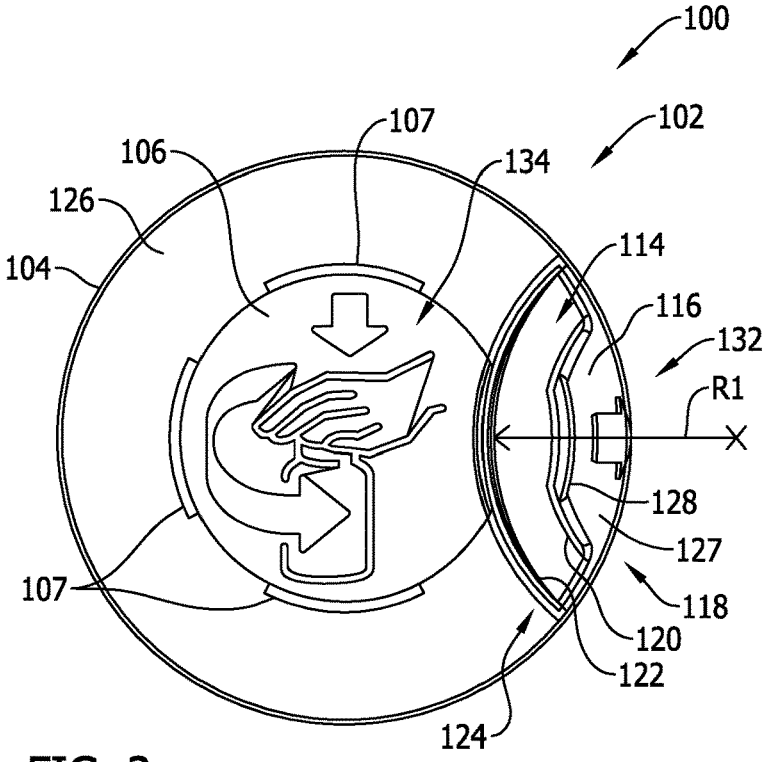
FIG. 2 is a top view of the container cap shown in FIG. 1.
Figure 3:
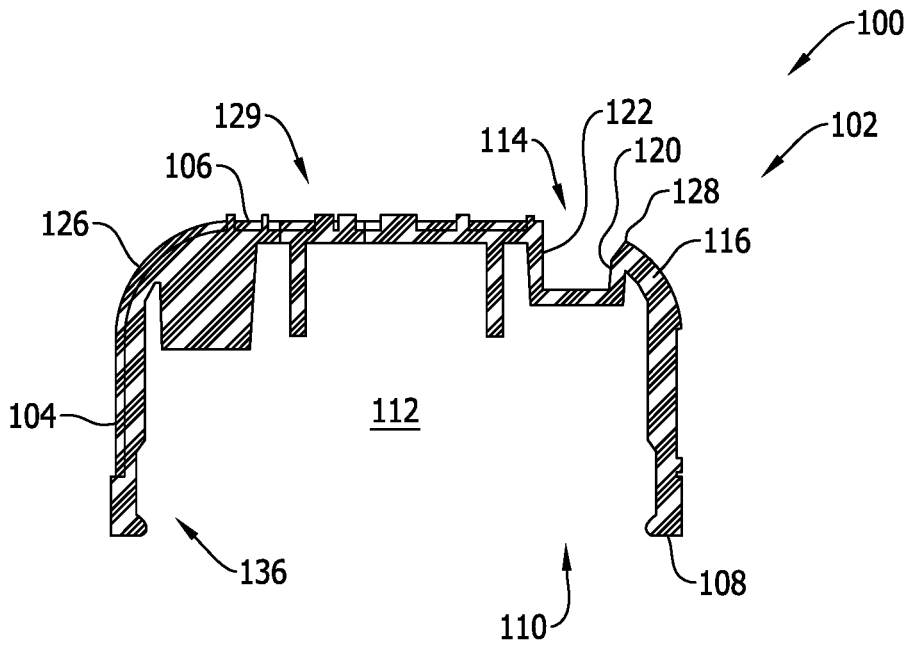
FIG. 3 is a cross-sectional view of the container cap shown in FIG. 1, taken along Line 3-3.

Referring now to the drawings, FIG. 1 is a perspective view of an example container cap 100, FIG. 2 is a top view of container cap 100, and FIG. 3 is a cross-sectional view of container cap 100, taken along Line 3-3 (shown in FIG. 1). In the example embodiment, container cap 100 includes a cap body 102 having a cylindrical-shaped side wall 104 and a top wall portion 106 integrated with cylindrical-shaped side wall 104. Top wall portion 106 includes a plurality of crenulations 107 extending therefrom. The plurality of crenulations 107 facilitate guiding container caps 100 during bottling, and also facilitates protecting container cap 100 and embossed text on container cap 100. Cylindrical-shaped side wall 104 has a bottom edge 108 that defines an opening 110 to an interior 112 of cap body 102, a band 113 that extends circumferentially about side wall 104 and facilitates guiding container caps 100 during bottling. In addition, top wall portion 106 at least partially encloses interior 112 of cap body 102.

In the example embodiment, container cap 100 includes a seal opening assembly 115 integrated with cap body 102. Seal opening assembly 115 includes a slot 114 defined in top wall portion 106 of cap body 102. Seal opening assembly 115 further includes a seal piercing member 116 formed on a first side 118 of slot 114. As will be described in more detail below, seal piercing member 116 is configured to pierce a seal covering an access opening in a container.

In one embodiment, slot 114 is oriented to define a first side wall 120 on first side 118 of slot 114 and a curved side wall 122 on a second side 124 of slot 114. Moreover, top wall portion 106 includes a rounded top edge 126 to improve the aesthetic appearance and ergonomic design of container cap 100. For example, container cap 100 is sized to fit into a palm of consumer's hand, and rounded top edge 126 improves the comfort for the consumer when the consumer's hand presses against container cap 100. In one embodiment, an outer surface 127 of seal piercing member 116 and first side wall 120 are oriented to converge relative to each other and define a piercing tip 128 on seal piercing member 116. As such, piercing tip 128 provides a tapered edge capable of piercing a seal of a container in a quick, safe, and efficient manner. The piercing tip 128 of the seal piercing member 116 is advantageously configured to decrease accidental injury to the consumer, due in part, for example, to the converging orientation of the outer surface 127, and the geometry and length of the piercing tip 128. In addition, in the example embodiment, top wall portion 106 includes an overmolded grip surface feature 129 that extends from top wall portion 106 such that container cap 100 is easily grippable when rotating container cap 100. In an alternative embodiment, overmolded grip surface feature 129 is formed on cylindrical-shaped side wall 104.

Referring to FIG. 2, slot 114 is oriented to extend arcuately across top wall portion 106. More specifically, slot 114 is oriented convexly relative to a longitudinal axis 130 (shown in FIG. 1) of cap body 102 such that seal piercing member 116 is defined on a peripheral edge 132 of cap body 102. In addition, as will be explained in further detail below, slot 114 is shaped to substantially match the contour of a neck portion of a container (both not shown in FIG. 2) such that the neck portion of the container is insertable within slot 114 when container cap 100 is aligned with the container in a predetermined orientation. For example, slot 114 defines a curved side wall 122 in top wall portion 106. Curved side wall 122 has a first radial size R1 selected to be greater than a radial size of the neck portion of the container. As such, as will be explained in more detail below, curved side wall 122 extends across a radially outer side of the neck portion, which facilitates ensuring container cap 100 is in the predetermined orientation, when container cap 100 is used to pierce the seal of the container.

In some embodiments, cap body 102 further includes at least one instructional guide feature formed thereon. For example, cap body 102 includes a first instructional guide feature 134 formed on top wall portion 106. First instructional guide feature 134 provides a pictorial representation illustrating a method of removing container cap 100 from a container. More specifically, the pictorial representation illustrates a method of translating and rotating container cap 100 relative to the container to remove container cap 100 therefrom. As such, the consumer is provided with easily comprehensible instructions on how to operate container cap 100. The first instructional guide feature 134 may include features to easily convey to the consumer instructions for use. For example, the first instructional guide feature 134 may include one or more different colors, the first instructional guide feature 134 also may or alternatively include texture, and/or embossed features.

Referring to FIG. 3, as described above, cylindrical-shaped side wall 104 and top wall portion 106 at least partially define interior 112 of cap body 102. Moreover, in the example embodiment, cylindrical-shaped side wall 104 includes a child-resistant feature 136 that facilitates impeding removal of container cap 100 from a container. Child-resistant feature 136 is designed such that container cap 100 must be translated and rotated relative to the container simultaneously to facilitate removal of container cap 100 therefrom. As such, child-resistant feature 136 provides protection against unauthorized access to the contents of the container by a minor, for example.

Figure 4:
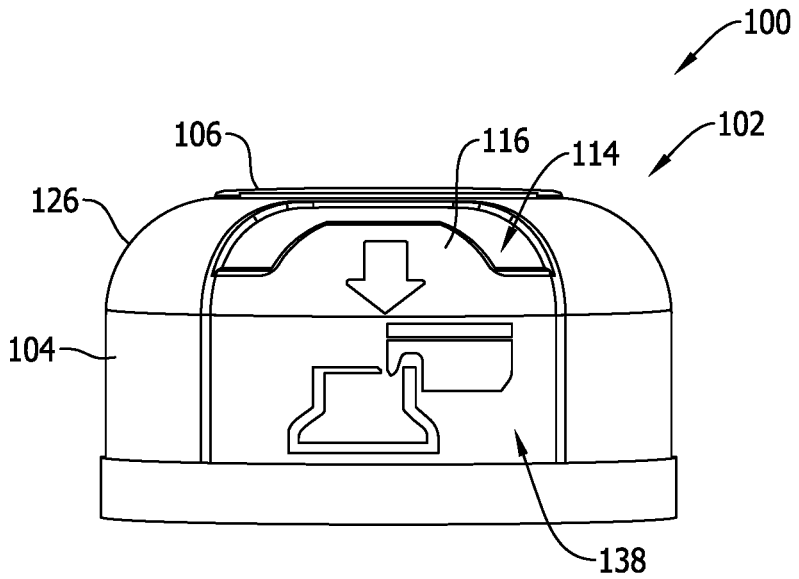
FIG. 4 is a front view of the container cap shown in FIG. 1.
Figure 5:
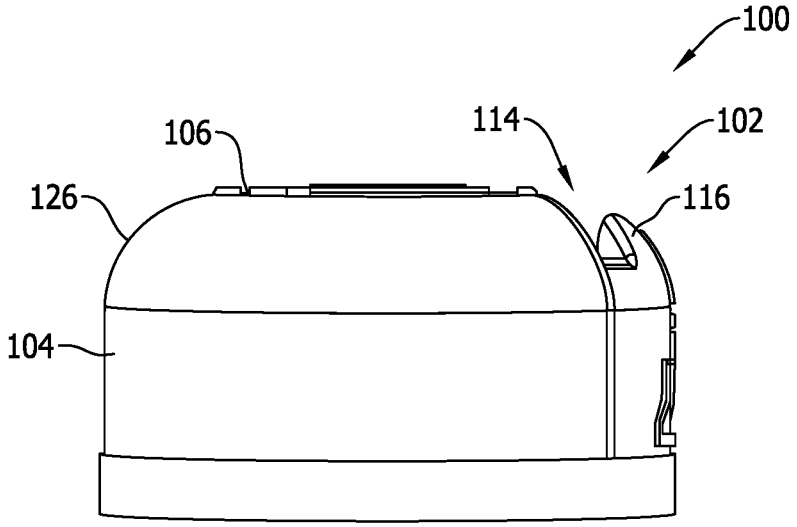
FIG. 5 is a side view of the container cap shown in FIG. 1.

FIG. 4 is a front view of container cap 100, and FIG. 5 is a side view of container cap 100. As described above, seal piercing member 116 is formed in rounded top edge 126 of top wall portion 106 of cap body 102. In the example embodiment, seal piercing member 116 is contoured to be substantially flush with an exterior profile of top wall portion 106 and rounded top edge 126 of top wall portion 106. More specifically, outer surface 127 of seal piercing member 116 is contoured to be substantially flush with an exterior profile of rounded top edge 126. As such, forming seal piercing member 116 to substantially match the exterior profile of top wall portion 106 and rounded top edge 126 facilitates improving the aesthetic appearance, and maintaining the ergonomic design, of container cap 100.

Referring to FIG. 4, cap body 102 includes a second instructional guide feature 138 formed on cylindrical-shaped side wall 104. Second instructional guide feature 138 provides a pictorial representation illustrating a method of piercing a seal covering a container with container cap 100, as will be described in more detail below. More specifically, the pictorial representation illustrates a method of positioning container cap 100 in a predetermined orientation relative to the container, and translating container cap 100 relative to the container to pierce the seal covering the container. As such, the consumer is provided with easily comprehensible instructions on how to operate container cap 100. The second instructional guide feature 138 may include features to easily convey to the consumer instructions for use. For example, the second instructional guide feature 138 may include one or more different colors, the first instructional guide feature 138 also may or alternatively include texture, and/or embossed features.

Figure 6:
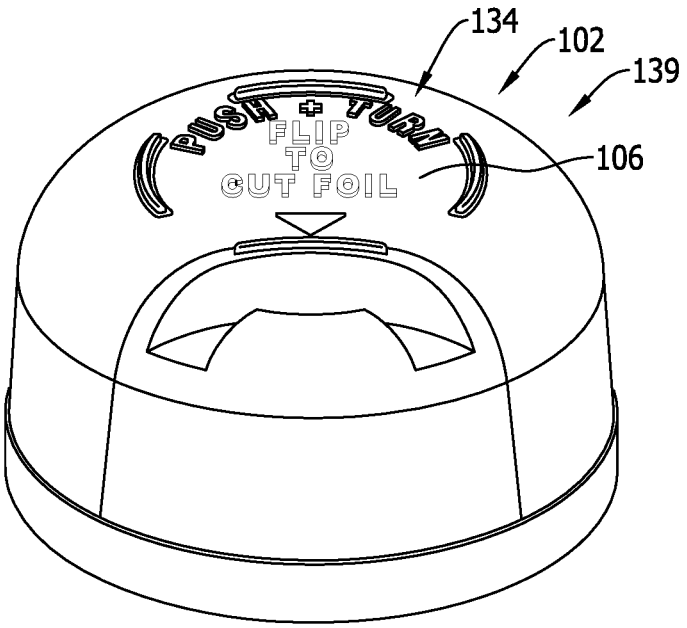
FIG. 6 is a perspective view of an alternative container cap.

FIG. 6 is a perspective view of an alternative container cap 139. In the example embodiment, container cap 139 includes cap body 102 including at least one instructional guide feature formed thereon. For example, cap body 102 includes first instructional guide feature 134 formed on top wall portion 106. First instructional guide feature 134 provides text-based instructions for operating container cap 139. For example, the text-based instructions instruct the consumer to push and turn container cap 139 to remove container cap 139 from a container. The text-based instructions also instruct the consumer to flip container cap 139 upside down to facilitate cutting seal 150 sealing the container. As such, the consumer is provided with easily comprehensible instructions on how to operate container cap 100.

Figure 7:
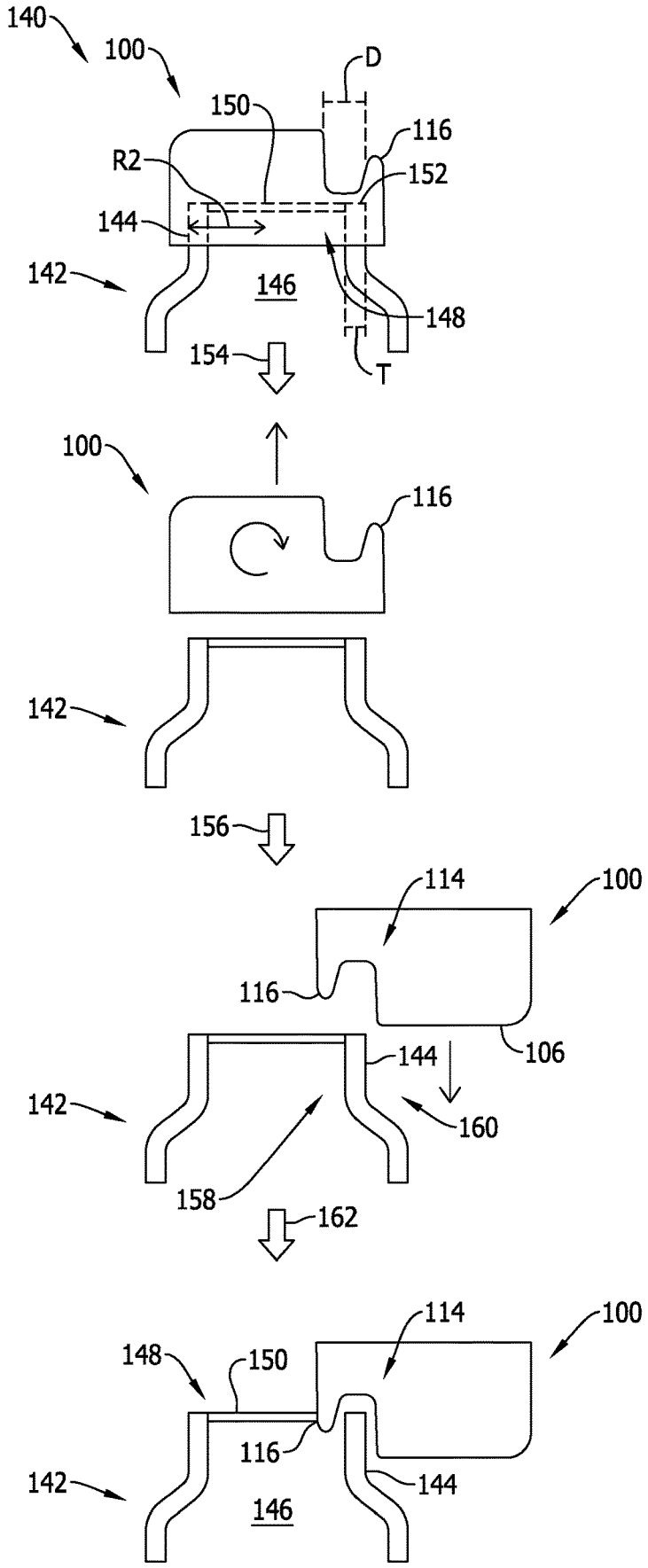
FIG. 7 is a flow diagram illustrating an example series of process steps for piercing a seal covering an opening of a container using the container cap shown in FIGS. 1 and 6.

FIG. 7 is a flow diagram illustrating an example series of process steps for piercing a seal covering an opening of a container 140 using container cap 100. In the example embodiment, container 140 includes a container body 142 and container cap 100. Container cap 100 is selectively removable from container body 142. Container body 142 includes a neck portion 144 and an interior 146. Neck portion 144 defines an opening 148 in container body 142 that provides access to interior 146, and container body 142 includes a seal 150 coupled to neck portion 144 such that the contents of interior 146 are sealed within container body 142. The seal 150 may be manufactured using any suitable material(s), such as foil, plastic, or paper. Neck portion 144 has a generally cylindrical shape, and is defined by a second radial size R2. As noted above, first radial size R1 (shown in FIG. 2) is greater than second radial size R2 such that neck portion 144 is insertable within slot 114 when piercing seal 150. In addition, seal piercing member 116 and curved side wall 122 are spaced from each other by a distance D, and a top edge 152 of neck portion 144 has a thickness T. In the example embodiment, distance D is greater than thickness T to further facilitate insertion of neck portion 144 within slot 114 when piercing seal 150 with container cap 100, as will be explained in further detail below.

In the example series of process steps, a first process step 154 includes removing container cap 100 from container body 142. Container cap 100 is then oriented in a predetermined orientation relative to container body 142 to facilitate positioning seal piercing member 116 in a piercing orientation relative to seal 150. For example, a second process step 156 includes orienting container cap 100 upside down relative to container body 142 such that top wall portion 106 is positioned adjacent container body 142. The second process step 156 further includes aligning slot 114 in cap body 102 with neck portion 144 of container body 142. More specifically, as described above, slot 114 is contoured to facilitate ensuring container cap 100 is in the predetermined orientation and, in the example embodiment, facilitates inhibiting the consumer from orienting container cap 100 in an orientation other than the predetermined orientation when using container cap 100 to pierce seal 150. When in the predetermined orientation, container cap 100 is positioned relative to container body 142 such that seal piercing member 116 is positioned on a radially inner side 158 of neck portion 144, and such that a majority of cap body 102 is positioned on a radially outer side 160 of neck portion 144. As such, the majority of cap body 102 overhangs from neck portion 144, which enables the consumer to easily grasp container cap 100 and execute a seal piercing operation.

A third process step 162 includes forcing container cap 100 towards container body 142 such that neck portion 144 is inserted within slot 114, and such that seal piercing member 116 pierces seal 150 covering opening 148. The contents within interior 146 of container body 142 may then be accessed by a consumer. In one embodiment, container cap 100 is translated circumferentially relative to neck portion 144 while neck portion 144 is inserted within slot 114. As such, seal piercing member 116 forms a larger opening in seal 150. Container body 142 may then be re-sealed with container cap 100.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container cap configured to couple to an access opening of a container, the access opening having a seal configured to cover the access opening, the container cap comprising:

a cap body comprising:

a cylindrical-shaped side wall having a circular bottom edge that defines an opening to an interior of said cap body; and a top wall portion, integrated with said cylindrical-shaped side wall and at least partially enclosing the interior of said cap body; and a seal opening assembly integrated with said cap body, wherein said seal opening assembly comprises:

a seal piercing member formed on said top wall portion, said seal piercing member comprising an outer surface and a first sidewall positioned radially inwardly of said outer surface, said outer surface and said first sidewall being oriented to converge toward one another to define a piercing tip, said piercing tip being configured to pierce the seal covering the access opening; and a second sidewall positioned radially inwardly on said top wall portion from said first sidewall, said first and second sidewalls defining a slot therebetween, the slot being sized to receive at least a portion of the container therein when the piercing tip pierces the seal.

2. The container cap in accordance with claim 1, wherein said slot is oriented to extend arcuately across said top wall portion.

3. The container cap in accordance with claim 2, wherein said slot is oriented convexly relative to a longitudinal axis of said cap body.

4. The container cap in accordance with claim 1, wherein said slot is oriented such that said seal piercing member is defined on a peripheral edge of said cap body.

5. The container cap in accordance with claim 1, wherein said seal piercing member is contoured to be flush with an exterior profile of said top wall portion.

6. The container cap in accordance with claim 1, wherein said top wall portion comprises a rounded top edge, and wherein an outer surface of said seal piercing member is contoured to be flush with an exterior profile of said rounded top edge.

7. The container cap in accordance with claim 1 further comprising an instructional guide feature integrally formed on said cap body.

8. The container cap in accordance with claim 1, wherein said top wall portion comprises an overmolded grip surface feature.

9. A container comprising:

a container body comprising a neck portion and an interior, wherein said neck portion defines an opening in said container body that provides access to said interior, and wherein said opening is configured to be covered by a seal; and a container cap selectively removable from said container body, said container cap comprising:

a cap body comprising:

a cylindrical-shaped side wall having a circular bottom edge that defines an opening to an interior of said cap body; and a top wall portion integrated with said cylindrical-shaped side wall and at least partially enclosing the interior of said cap body; and a seal opening assembly integrated with said cap body; and a seal piercing member formed on said top wall portion, said seal piercing member comprising an outer surface and a first sidewall positioned radially inwardly of said outer surface, the outer surface and first sidewall being oriented to converge toward one another to define a piercing tip, said piercing tip configured to pierce the seal covering the access opening; and a second sidewall spaced radially inwardly on said top wall portion from the first sidewall, said first and second sidewalls defining a slot therebetween, the slot being sized to receive at least a portion of the container therein when the piercing tip pierces the seal.

10. The container in accordance with claim 9, wherein said slot is oriented to define a curved side wall in said top wall portion, said curved side wall having a greater radial size than said neck portion.

11. The container in accordance with claim 10, wherein said seal piercing member and said curved side wall are spaced from each other by a distance greater than a thickness of a top edge of said neck portion.

12. The container in accordance with claim 9, wherein said slot is oriented to extend arcuately across said top wall portion.

13. The container in accordance with claim 9, wherein said slot is oriented such that said seal piercing member is defined on a peripheral edge of said cap body.

14. The container in accordance with claim 9, wherein said seal piercing member is contoured to be flush with an exterior profile of said top wall portion.

15. The container in accordance with claim 14, wherein said top wall portion comprises a rounded top edge, and wherein an outer surface of said seal piercing member is contoured to be flush with an exterior profile of said rounded top edge.

* * * * *